US011601739B2

(12) United States Patent
Cheng et al.

(10) Patent No.: US 11,601,739 B2
(45) Date of Patent: Mar. 7, 2023

(54) LIGHT SPEAKER STRUCTURE WITH RING HANDLE

(71) Applicant: SainStore Technology Co., Ltd., Guangdong (CN)

(72) Inventors: Tianle Cheng, Guangdong (CN); Shuhao Li, Guangdong (CN)

(73) Assignee: SainStore Technology Co., Ltd., Dongguan (CN)

( * ) Notice: Subject to any disclaimer, the term of this patent is extended or adjusted under 35 U.S.C. 154(b) by 0 days.

(21) Appl. No.: 17/577,002

(22) Filed: Jan. 16, 2022

(65) Prior Publication Data

US 2022/0386002 A1 Dec. 1, 2022

(30) Foreign Application Priority Data

May 25, 2021 (CN) ..... 202121141043.3

(51) Int. Cl.

| | |
|---|---|
| ***H04R 1/02*** | (2006.01) |
| ***H04R 3/00*** | (2006.01) |
| ***F21V 33/00*** | (2006.01) |
| ***F21Y 103/10*** | (2016.01) |
| ***F21Y 115/10*** | (2016.01) |

(52) U.S. Cl.
CPC ..... *H04R 1/028* (2013.01); *F21V 33/0056* (2013.01); *H04R 3/00* (2013.01); *F21Y 2103/10* (2016.08); *F21Y 2115/10* (2016.08)

(58) Field of Classification Search
CPC ..... H04R 1/028; H04R 3/00; F21V 33/0056
USPC ..... 381/300
See application file for complete search history.

(56) References Cited

U.S. PATENT DOCUMENTS

| | | | | |
|---|---|---|---|---|
| 9,473,191 | B1 * | 10/2016 | Raymond | A45C 13/02 |
| 2012/0213397 | A1 * | 8/2012 | Crotts | H04R 1/02 381/334 |
| 2015/0010189 | A1 * | 1/2015 | Besay | H04R 1/028 381/334 |
| 2015/0124994 | A1 * | 5/2015 | Cheung | H04R 5/04 381/77 |
| 2015/0139464 | A1 * | 5/2015 | Guo | H04R 1/04 381/334 |
| 2015/0201295 | A1 * | 7/2015 | Lau | H04R 29/008 381/59 |
| 2017/0105069 | A1 * | 4/2017 | Mezzomo | H04R 1/026 |
| 2018/0005612 | A1 * | 1/2018 | Finelli, III | F21V 33/0056 |
| 2018/0042346 | A1 * | 2/2018 | Kong | A45B 25/00 |
| 2018/0356088 | A1 * | 12/2018 | Horne | A47G 23/0216 |

(Continued)

*Primary Examiner* — Bryon T Gyllstrom

(57) ABSTRACT

A light speaker structure with a ring handle includes a speaker body, a speaker enclosure, a lighting mechanism and an auxiliary mechanism. The speaker body is mounted within the speaker enclosure, and the auxiliary mechanism is mounted on the speaker enclosure. The lighting mechanism includes a lampshade, a light strip, and LED beads. The light strip is mounted within the lampshade. The LED beads are fixedly connected to the light strip and electrically connected to the speaker body. The light strip is disposed in a laterally inverted C-shape around the speaker enclosure. The lampshade covers the light strip, so that the light strip is held between the lampshade and the speaker enclosure. The light strip and the lampshade are so shaped that they can be arranged around the speaker enclosure, thereby achieving a better lighting effect, providing a larger lighting area and producing a stereoscopic effect.

7 Claims, 3 Drawing Sheets

(56) References Cited

U.S. PATENT DOCUMENTS

| | | | | |
|---|---|---|---|---|
| 2019/0052942 | A1* | 2/2019 | Pavelic | H04R 1/2857 |
| 2019/0248332 | A1* | 8/2019 | De Wind | B60Q 1/2696 |
| 2020/0196038 | A1* | 6/2020 | Curtiss | H04R 9/022 |

* cited by examiner

LIGHT SPEAKER STRUCTURE WITH RING HANDLE

CROSS REFERENCE TO RELATED APPLICATIONS

The present application claims the benefit of Chinese Patent Application No. 202121141043.3 filed on May 25, 2021, the contents of which are incorporated herein by reference in their entirety.

TECHNICAL FIELD

The present application relates to the field of multimedia devices, and in particular, to a light speaker structure with a ring handle.

BACKGROUND ART

A speaker refers to a device that can convert audio signals into sound. Generally, a speaker is composed of a speaker box or a subwoofer box, and a power amplifier located therein to amplify audio signals before sound playback by the speaker body, thereby making the sound louder.

A traditional speaker may have a small light-emitting area and an unsatisfactory lighting effect because a light source used therein emits light inwardly. Moreover, the speaker is inconvenient to control and operate when used in connection with an external device. Further, the speaker is not easy to place stably, carry and move, and inconvenient to use. Therefore, a light speaker structure with a ring handle is provided to solve such problems.

SUMMARY OF THE INVENTION

An embodiment of the present application provides a light speaker structure with a ring handle to solve the problems of small light-emitting area, unsatisfactory lighting effect, and inconvenient use, carrying and moving of a speaker in the prior art.

According to one aspect of the present application, there is provided a light speaker structure with a ring handle, including a speaker body, a speaker enclosure, a lighting mechanism and an auxiliary mechanism. The speaker body is mounted within the speaker enclosure. The speaker enclosure is larger in size than the speaker body. The auxiliary mechanism is mounted on the speaker enclosure.

The lighting mechanism includes a lampshade, a light strip, and LED beads. The light strip is mounted within the lampshade. The LED beads are fixedly connected to the light strip and electrically connected to the speaker body.

The light strip is disposed in a laterally inverted C-shape around the speaker enclosure. The lampshade is also disposed in the laterally inverted C-shape around the speaker enclosure. The lampshade covers the light strip, so that the light strip is held between the lampshade and the speaker enclosure. The light strip and the lampshade are so shaped that they can be arranged around the speaker enclosure, thereby achieving a better lighting effect, providing a larger lighting area and producing a stereoscopic effect.

Further, the lampshade is gradually increased in width from the middle to two sides thereof to achieve a better installation effect.

Further, a fan-shaped through hole is formed in the top of the speaker enclosure and located above the speaker body.

Further, the auxiliary mechanism includes a loudspeaker, a protective net and a connection interface. The loudspeaker is mounted in the speaker body. The protective net is embedded in the speaker enclosure and located on one side of the speaker body.

Further, two connection interfaces are mounted at the top of the speaker enclosure and electrically connected to the speaker body. A control panel which is disposed below the connection interfaces is fixedly connected to the speaker enclosure and located above the protective net.

Further, the lampshade includes a first lampshade and two second lampshades. The first lampshade and the second lampshades are engaged with the outside of the speaker enclosure. The two second lampshades are located on the left and right sides of the loudspeaker, and the first lampshade is located above the loudspeaker.

Further, each of the first lampshade and the second lampshades has an arc-shaped structure. The two second lampshades are joined to two ends of the first lampshade, respectively, thereby forming a C-shape with the first lampshade.

Further, the light strip is fixedly connected to the outside of the speaker enclosure. The LED beads are located between the light strip and the lampshade. The light strip is thinner than the speaker enclosure.

According to the foregoing embodiment of the present application, with the lighting mechanism and the auxiliary mechanism, the problems of small light-emitting area, unsatisfactory lighting effect, and inconvenient use, carrying and moving of a speaker are solved, and good lighting effect, and convenient use, carrying and moving of the speaker are achieved.

BRIEF DESCRIPTION OF THE DRAWINGS

To explain the technical solutions in the embodiments of the present application or in the prior art more clearly, the accompanying drawings required for describing the embodiments or the prior art will be briefly described below. Apparently, the accompanying drawings in the following description show some embodiments of the present application, and a person of ordinary skill in the art can derive other drawings from these accompanying drawings without creative work.

Figure 1:
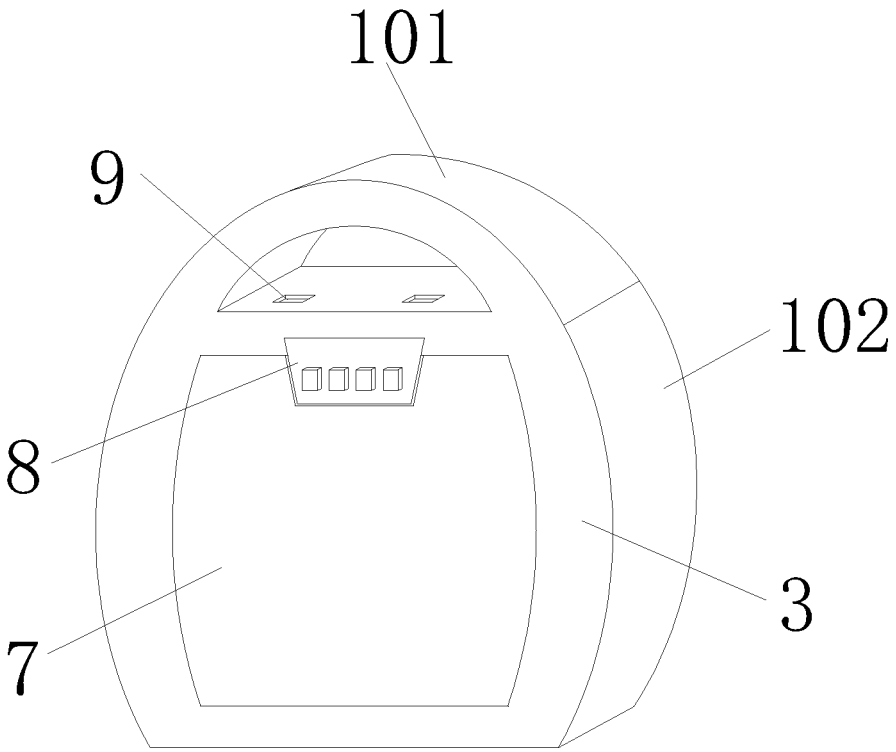
FIG. 1 is a schematic diagram of a three-dimensional structure according to an embodiment of the present application.

In the drawings: 1—lampshade, 101—first lampshade, 102—second lampshade, 2—loudspeaker, 3—speaker enclosure, 4—speaker body, 5—light strip, 6—LED bead, 7—protective net, 8—control panel, and 9—connection interface.

DETAILED DESCRIPTION OF THE INVENTION

To provide a better understanding of the solutions in the present application for a person skilled in the art, the technical solutions in the embodiments of the present application will be described below clearly and completely with reference to the accompanying drawings used herein. Apparently, the described embodiments are merely some rather than all of the embodiments of the present application. All other embodiments obtained by those of ordinary skill in the art based on the embodiments of the present application without creative work shall fall within the protection scope of the present application.

It should be noted that the terms "first", "second" and the like used in the description and claims of the present application and in the above accompanying drawings are intended to distinguish between similar objects but do not necessarily indicate a specific order or sequence. It should be understood that the data termed in such a way are interchangeable in proper circumstances, so that the embodiments of the present application described herein can be implemented in other orders than the order illustrated or described herein. Moreover, the terms "include", "have", and any other variants thereof mean to cover the non-exclusive inclusion, for example, a process, method, system, product, or device that includes a list of steps or units is not necessarily limited to those steps or units which are clearly listed, but may include other steps or units which are not expressly listed or inherent to such a process, method, system, product, or device.

It should be understood that in the description of the present application, orientations or positional relationships indicated by terms such as "above", "below", "left", "right", "front", "rear", "top", "bottom", "inside", "outside", "central", "vertical", "horizontal", "transverse", "longitudinal" are all based on what are illustrated in the drawings. Such terms are used herein for ease and simplification of description of the present application and embodiments thereof rather than limiting that the stated device, element or component must have a specific orientation or must be constructed and operated in a specific orientation.

Moreover, in addition to indicating orientations or positional relationships, some of the above-mentioned terms may also be used for indicating other implications. For example, the term "above" may also be used for indicating an attachment relationship or connection relationship in some circumstances. A person of ordinary skill in the art will understand specific meanings of such terms in the present application based on a specific situation.

In addition, the meanings of the terms "mount", "dispose", "connect" and "sleeve" should be understood in a board sense. For example, the connection may be a fixed connection, a removable connection, or an integral connection; it may be a mechanical connection or an electrical connection; it may be a direct connection or an indirect connection by using an intermediate medium; or it may be intercommunication between two components. A person of ordinary skill in the art may understand specific meanings of such terms in the present application based on a specific situation.

It should be noted that the embodiments in the present application and features in the embodiments can be combined with one another without conflict. The present application will be described in detail below with reference to the accompanying drawings and in conjunction with the embodiments.

Referring to FIG. 1 to FIG. 5, a light speaker structure with a ring handle provided by the present invention includes a speaker body 4, a lighting mechanism, and an auxiliary mechanism. The speaker body 4 is mounted in a speaker enclosure 3. The speaker enclosure 3 is larger in size than the speaker body 4, so that the speaker enclosure 3 covers and protects the speaker body 4.

The lighting mechanism includes a lampshade 1, a light strip 5, and LED beads 6. The light strip 5 is mounted within the lampshade 1. The LED beads 6 are fixedly connected to the light strip 5. The LED beads 6 are electrically connected to the speaker body 4, so that the LED beads 6 operate along with the speaker body 4.

The light strip 5 is disposed in a laterally inverted C-shape around the speaker enclosure 3. The whole lampshade 1 is also disposed in the laterally inverted C-shape around the speaker enclosure 3. The lampshade covers the light strip, so that the light strip 5 is held between the lampshade 1 and the speaker enclosure 3. Moreover, the lampshade is gradually increased in width from the middle to two sides thereof, and gradually decreased in width from two sides to the ends thereof.

The auxiliary mechanism is mounted on the speaker enclosure 3. A fan-shaped through hole is formed in the top of the speaker enclosure 3. The fan-shaped through hole is located above the speaker body 4, thereby being conducive to carrying and moving the entire speaker.

The auxiliary mechanism includes a loudspeaker 2, a protective net 7 and a connection interface 9. The loudspeaker 2 is mounted in the speaker body 4. The protective net 7 is arranged on one side of the speaker body 4. The protective net 7 is embedded in the speaker enclosure 3, thereby being conducive to playing an audio source by the loudspeaker 2. Two connection interfaces 9 are mounted at the top of the speaker enclosure 3. The connection interfaces 9 are electrically connected to the speaker body 4. A control panel 8 is disposed below the connection interfaces 9. The control panel 8 is fixedly connected to the speaker enclosure 3 and located above the protective net 7, thereby being conducive to the connection and use of the speaker. The light strip 5 is fixedly connected to the outside of the speaker enclosure 3. The LED beads 6 are located between the light strip 5 and the lampshade 1. The light strip 5 is thinner than the speaker enclosure 3, thereby being conducive to covering and protection of the light strip 5 with the lampshade 1.

Figure 2:
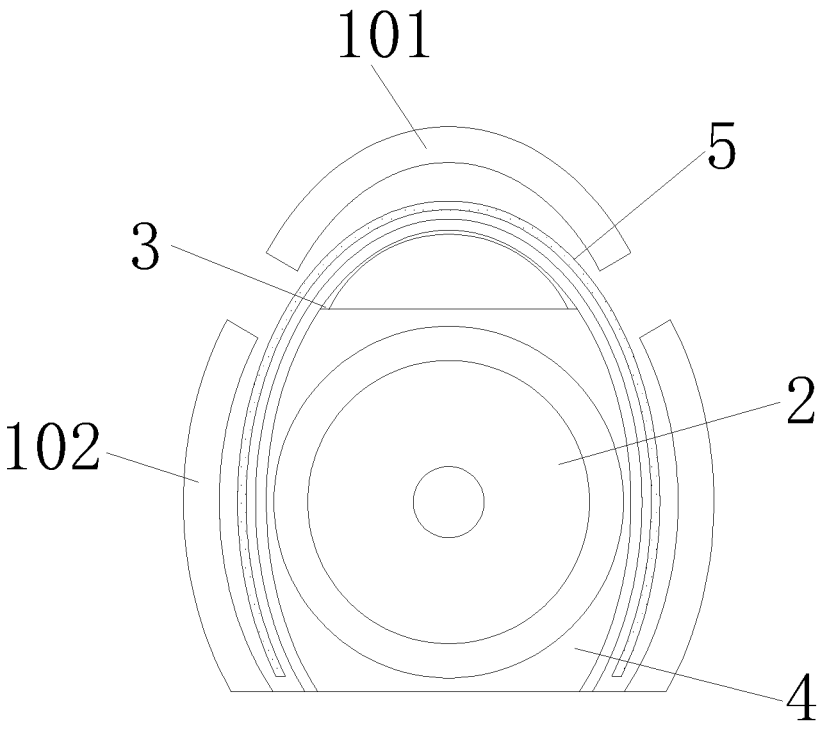
FIG. 2 is a schematic diagram of an integral structure according to an embodiment of the present application.
Figure 3:
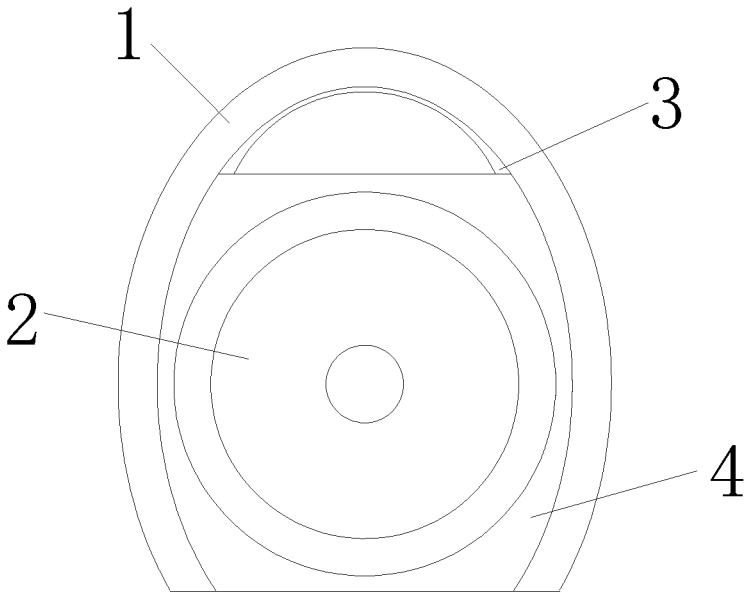
FIG. 3 is a schematic diagram of a lampshade structure according to an embodiment of the present application.
Figure 4:
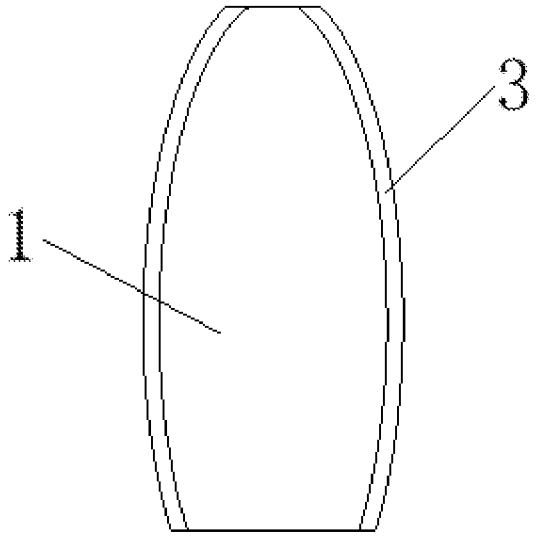
FIG. 4 is a schematic diagram of a side of a speaker enclosure structure according to an embodiment of the present application.
Figure 5:
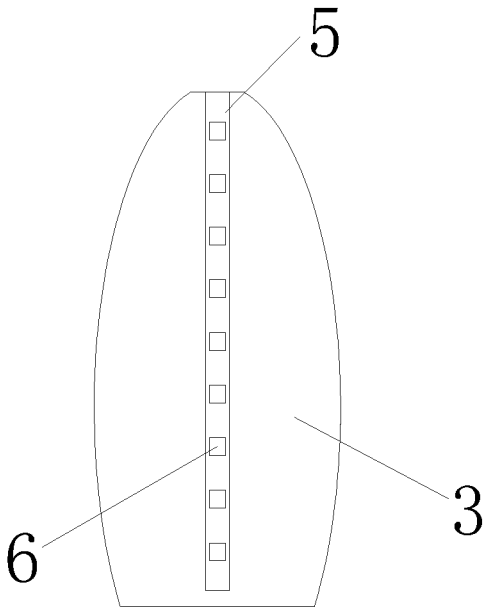
FIG. 5 is an installation diagram of an LED bead structure according to an embodiment of the present application.

In other embodiments, the lampshade may have a split structure to facilitate manufacturing thereof. As shown in FIG. 2, in the light speaker structure with a ring handle provided by the present invention, the lampshade 1 includes a first lampshade 101 and two second lampshades 102. The first lampshade 101 and the second lampshades 102 are engaged with the outside of the speaker enclosure 3. The two second lampshades 102 are located on the left and right sides of the loudspeaker 2, and the first lampshade 101 is located above the loudspeaker 2.

Each of the first lampshade 101 and the second lampshades 102 has an arc-shaped structure. The two second lampshades 102 are joined to two ends of the first lampshade 101, respectively, thereby forming a C-shape with the first lampshade 101. With the C-shape, omnidirectional lighting can be provided for a user.

The first lampshade 101 and the second lampshades 102 house the light strip 5 and the LED beads 6, and are all engaged with the speaker enclosure 3. With the improvement of the structure described above, the molding and mounting of the lampshade 1 can be achieved with significantly enhanced convenience.

In use, electrical elements mentioned in the present invention are all connected to an external power source and a control switch in use. The lampshade 1 or the first lampshade 101 and the second lampshades 102 are firstly mounted on the speaker enclosure 3 to cover the LED beads 6 and the light strip 5. An external USB device is connected to the connection interface 9 of the speaker enclosure 3. The speaker body 4 and the loudspeaker 2 are controlled to operate by using control keys on the control panel 8. The protective net 7 is conducive to playing an audio source by the loudspeaker 2 and moderating the lighting effect of the light strip 5. The LED beads 6 are lit up on the light strip 5 and can be viewed through the transparent lampshade 1 or the first lampshade 101 and the second lampshades 102. Thus, the light-emitting area of the whole speaker can be increased, and the light can exit, thereby enhancing the lighting effect of the speaker.

The speaker structure in the embodiment can be applied to various loudspeakers.

The present application has the following advantages:

1. The speaker structure provided by the present application is simple to operate. The first lampshade 101 and the second lampshades 102 can cover and protect the light strip 5, reduce blocking of light emitted by the LED beads 6, increase the light-emitting area of the speaker, and improve the emergent light from the speaker.

2. The speaker structure provided by the present application is reasonable. The connection interfaces 9 and the control panel 8 are conducive to the connection of an external device and the control and use of the speaker body 4. The speaker enclosure 3 is conducive to the stable placement of the whole speaker, so that the speaker is easy to carry and move, and convenient to use.

Circuits, and electronic components and modules involved all pertain to the prior art, which can be implemented by a person skilled in the art easily and will not be described in detail here. Besides, the claimed contents of the present application do not involve improvements on software and method.

The foregoing is merely descriptions of the preferred embodiments of the present application, and is not intended to limit the disclosure. For a person skilled in the art, various modifications and changes can be made to the present application. Any modifications, equivalent replacements, improvements and the like made within the spirit and principle of the present application shall fall within the protection scope of the present application.

What is claimed is:

1. A light speaker structure with a ring handle, comprising a speaker body, a speaker enclosure, a lighting mechanism and an auxiliary mechanism, wherein the speaker body is mounted within the speaker enclosure, and the auxiliary mechanism is mounted on the speaker enclosure;

the lighting mechanism comprises a lampshade, a light strip, and LED beads; the light strip is mounted within the lampshade; the LED beads are fixedly connected to the light strip and electrically connected to the speaker body; and the light strip is disposed in a laterally inverted C-shape around the speaker enclosure; and the lampshade covers the light strip, so that the light strip is held between the lampshade and the speaker enclosure;

wherein that the lampshade is gradually increased in width from the middle to two sides thereof.

2. The light speaker structure with a ring handle according to claim 1, wherein that a fan-shaped through hole is formed in the top of the speaker enclosure and located above the speaker body.

3. The light speaker structure with a ring handle according to claim 1, wherein that the auxiliary mechanism comprises a loudspeaker, a protective net and a connection interface; the loudspeaker is mounted in the speaker body; and the protective net is embedded in the speaker enclosure and located on one side of the speaker body.

4. The light speaker structure with a ring handle according to claim 3, wherein that two connection interfaces are mounted at the top of the speaker enclosure and electrically connected to the speaker body; and a control panel which is disposed below the connection interfaces is fixedly connected to the speaker enclosure and located above the protective net.

5. A light speaker structure with a ring handle, comprising a speaker body, a speaker enclosure, a lighting mechanism and an auxiliary mechanism, wherein the speaker body is mounted within the speaker enclosure, and the auxiliary mechanism is mounted on the speaker enclosure;

the lighting mechanism comprises a lampshade, a light strip, and LED beads; the light strip is mounted within the lampshade; the LED beads are fixedly connected to the light strip and electrically connected to the speaker body; and the light strip is disposed in a laterally inverted C-shape around the speaker enclosure; and the lampshade covers the light strip, so that the light strip is held between the lampshade and the speaker enclosure, wherein that the lampshade comprises a first lampshade and two second lampshades; the first lampshade and the second lampshades are engaged with the outside of the speaker enclosure; the two second lampshades are located on the left and right sides of the loudspeaker; and the first lampshade is located above the loudspeaker.

6. The light speaker structure with a ring handle according to claim 5, wherein that each of the first lampshade and the second lampshades has an arc-shaped structure; and the two second lampshades are joined to two ends of the first lampshade, respectively, thereby forming a C-shape with the first lampshade.

7. A light speaker structure with a ring handle, comprising a speaker body, a speaker enclosure, a lighting mechanism and an auxiliary mechanism, wherein the speaker body is mounted within the speaker enclosure, and the auxiliary mechanism is mounted on the speaker enclosure;

the lighting mechanism comprises a lampshade, a light strip, and LED beads; the light strip is mounted within the lampshade; the LED beads are fixedly connected to the light strip and electrically connected to the speaker body; and the light strip is disposed in a laterally inverted C-shape around the speaker enclosure; and the lampshade covers the light strip, so that the light strip is held between the lampshade and the speaker enclosure, wherein that the light strip is fixedly connected to the outside of the speaker enclosure; and the LED beads are located between the light strip and the lampshade; and the light strip is thinner than the speaker enclosure.

* * * * *